US007898178B2

(12) United States Patent
Ahn

(10) Patent No.: US 7,898,178 B2
(45) Date of Patent: Mar. 1, 2011

(54) PLASMA DISPLAY DEVICE WITH AUXILIARY ELECTRODES

(75) Inventor: Sung Yong Ahn, Gumi-si (KR)

(73) Assignee: LG Electronics Inc., Seoul (KR)

( * ) Notice: Subject to any disclaimer, the term of this patent is extended or adjusted under 35 U.S.C. 154(b) by 334 days.

(21) Appl. No.: 11/942,893

(22) Filed: Nov. 20, 2007

(65) Prior Publication Data

US 2008/0122357 A1 May 29, 2008

(30) Foreign Application Priority Data

Nov. 24, 2006 (KR) ..... 10-2006-0117110

(51) Int. Cl.
*H01J 17/49* (2006.01)

(52) U.S. Cl. ..... 313/585; 313/582; 313/583

(58) Field of Classification Search ..... 313/582–587
See application file for complete search history.

(56) References Cited

U.S. PATENT DOCUMENTS

| | | | | |
|---|---|---|---|---|
| 6,097,149 | A * | 8/2000 | Miyaji et al. | 313/582 |
| 6,297,590 | B1 * | 10/2001 | Nanto et al. | 313/586 |
| 6,344,714 | B1 * | 2/2002 | Su et al. | 313/582 |
| 6,483,491 | B1 | 11/2002 | Lee | 348/60 |
| 2002/0140350 | A1 * | 10/2002 | Koshio et al. | 313/586 |
| 2002/0190652 | A1 * | 12/2002 | Do et al. | 313/587 |
| 2004/0000873 | A1 | 1/2004 | Moon | 313/587 |
| 2004/0041522 | A1 * | 3/2004 | Takada et al. | 313/586 |
| 2004/0150340 | A1 * | 8/2004 | Son et al. | 313/582 |
| 2005/0179384 | A1 * | 8/2005 | Kwon et al. | 313/583 |
| 2006/0033437 | A1 * | 2/2006 | Eom | 313/586 |
| 2006/0175969 | A1 * | 8/2006 | Bae et al. | 313/582 |
| 2006/0255728 | A1 * | 11/2006 | Chung | 313/582 |

FOREIGN PATENT DOCUMENTS

| | | |
|---|---|---|
| EP | 1 688 982 | 8/2006 |

OTHER PUBLICATIONS

European Search Report dated Nov. 16, 2010.

* cited by examiner

*Primary Examiner* — Bumsuk Won
*Assistant Examiner* — Kevin Quarterman
(74) *Attorney, Agent, or Firm* — KED & Associates, LLP

(57) ABSTRACT

A plasma display device is provided. The plasma display device may include a plasma display panel (PDP), an upper substrate and a lower substrate, a plurality of scan electrodes and a plurality of sustain electrodes on the upper substrate, a plurality of first barrier ribs on the lower substrate in parallel with the scan electrodes and the sustain electrodes, a plurality of second barrier ribs on the lower substrate, that intersect the first barrier ribs, and are higher than the first barrier ribs, and a plurality of auxiliary electrodes on the upper substrate and overlap the first barrier ribs. Accordingly, the amount of invalid power of a PDP may be reduced by preventing crosstalk from occurring between a pair of sustain electrodes with a barrier rib interposed therebetween.

20 Claims, 15 Drawing Sheets

PLASMA DISPLAY DEVICE WITH AUXILIARY ELECTRODES

This application claims priority from Korean Patent Application No. 10-2006-0117110 filed on Nov. 24, 2006 in the Korean Intellectual Property Office, the disclosure of which is incorporated herein by reference in its entirety.

BACKGROUND OF THE INVENTION

1. Field of the Invention

The present invention relates to a plasma display device, and more particularly, to a plasma display device in which the amount of invalid power generated during the operation of a plasma display panel (PDP) can be reduced by forming auxiliary electrodes on an upper substrate so that the auxiliary electrodes can overlap respective corresponding horizontal barrier ribs.

2. Description of the Related Art

Plasma display panels (PDPs) are display devices which display an image, including text data and graphic data, by applying a predetermined voltage to a number of electrodes installed in a discharge space to cause a gas discharge and then exciting phosphors with the aid of plasma that is generated as a result of the gas discharge. PDPs are easy to manufacture as large-dimension thin flat displays. In addition, PDPs can provide wide viewing angles, full colors and high luminance.

In order to improve the luminance and brightness of an image displayed on a PDP, a PDP architecture has been developed in which the height of horizontal barrier ribs is lower than the height of vertical barrier ribs. This PDP architecture, however, results in crosstalk between sustain electrodes.

SUMMARY OF THE INVENTION

The present invention provides a plasma display device in which auxiliary electrodes are disposed in parallel with sustain electrodes and overlap respective corresponding horizontal barrier ribs so that crosstalk can be prevented from being generated regardless of a low height of the horizontal barrier ribs, and that the amount of invalid power can be minimized.

According to an aspect of the present invention, there is provided a plasma display device including a plasma display panel (PDP); an upper substrate and a lower substrate which face each other; a plurality of scan electrodes and a plurality of sustain electrodes which are disposed on the upper substrate; a plurality of first barrier ribs which are disposed on the lower substrate in parallel with the scan electrodes and the sustain electrodes; a plurality of second barrier ribs which are disposed on the lower substrate, intersect the first barrier ribs, and are higher than the first barrier ribs; and a plurality of auxiliary electrodes which are disposed on the upper substrate and overlap the first barrier ribs.

The auxiliary electrodes may be spaced apart from the respective scan electrodes and from the respective sustain electrodes.

A width of the auxiliary electrodes may be greater than at least one of a distance between the auxiliary electrodes and the respective scan electrodes and a distance between the auxiliary electrodes and the respective sustain electrodes.

The auxiliary electrodes may include floating electrodes which are disconnected from a power supply.

The auxiliary electrodes may be connected to a ground.

A predetermined voltage may be applied to the auxiliary electrodes.

The auxiliary electrodes may include indium tin oxide (ITO).

The auxiliary electrodes may be darker than phosphors that emit light upon receiving ultraviolet rays generated during a discharge.

The auxiliary electrodes may include black matrices.

The auxiliary electrodes may be adjacent to the respective scan electrodes and to the respective sustain electrodes.

The auxiliary electrodes may be discontinuous.

The auxiliary electrodes may be discontinuous at intersections between the first barrier ribs and the second barrier ribs.

A width of the auxiliary electrodes may be 0.7-1.3 times greater than an upper width of the first barrier ribs.

A width of the auxiliary electrodes may be 0.9-1.1 times greater than an upper width of the first barrier ribs.

Some of the first barrier ribs may have concave top surfaces.

The first barrier ribs may be 5-32 μm lower than the second barrier ribs.

A thickness of the auxiliary electrodes may be substantially the same as at least one of a thickness of the scan electrodes and a thickness of the sustain electrodes.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

The present invention will hereinafter be described in detail with reference to the accompanying drawings in which exemplary embodiments of the invention are shown.

Figure 1:
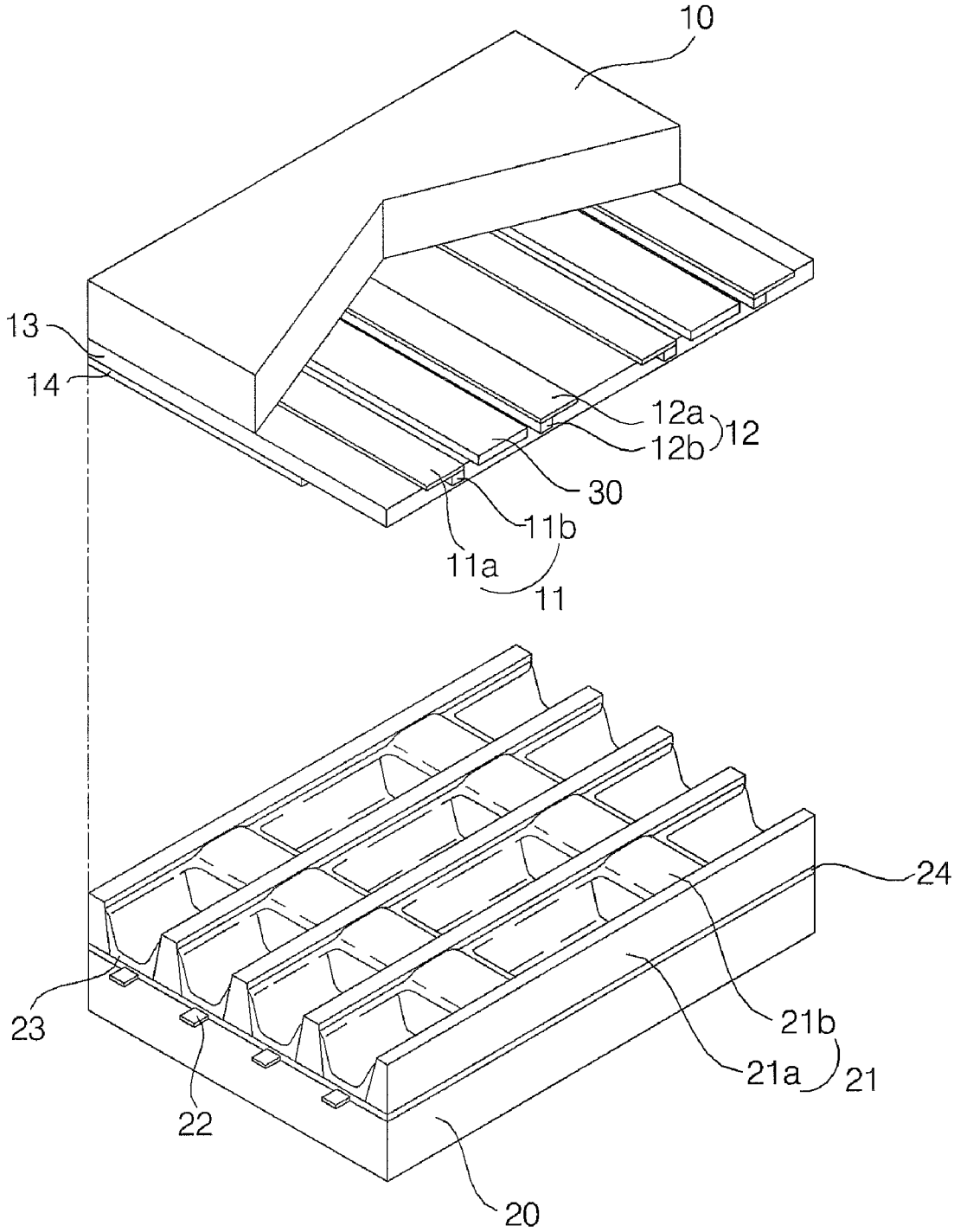
FIG. 1 illustrates a perspective view of a plasma display panel (PDP) according to an embodiment of the present invention.

FIG. 1 is a perspective view of a plasma display panel (PDP). Referring to FIG. 1, the PDP includes an upper substrate 10, a plurality of sustain electrode pairs which are formed on the upper substrate 10 and consist of a scan electrode 11 and a sustain electrode 12 each; a lower substrate 20; and a plurality of address electrodes 22 which are formed on the lower substrate 20.

Each of the sustain electrode pairs includes transparent electrodes 11*a* and 12*a* and bus electrodes 11*b* and 12*b*. The transparent electrodes 11*a* and 12*a* may be formed of indium-tin-oxide (ITO). The bus electrodes 11*b* and 12*b* may be formed of a metal such as silver (Ag) or chromium (Cr) or may be comprised of a stack of chromium/copper/chromium (Cr/Cu/Cr) or a stack of chromium/aluminium/chromium (Cr/Al/Cr). The bus electrodes 11*b* and 12*b* are respectively formed on the transparent electrodes 11*a* and 12*a* and reduce a voltage drop caused by the transparent electrodes 11*a* and 12*a* which have a high resistance.

According to an embodiment of the present invention, each of the sustain electrode pairs may be comprised of the bus electrodes 11*b* and 12*b* only. In this case, the manufacturing cost of the PDP can be reduced by not using the transparent electrodes 11*a* and 12*a*. The bus electrodes 11*b* and 12*b* may be formed of various materials other than those set forth herein, e.g., a photosensitive material.

An upper dielectric layer 13 and a passivation layer 14 are deposited on the upper substrate 10 on which the scan electrodes 11 and the sustain electrodes 12 are formed. Charged particles generated as a result of a discharge accumulate in the upper dielectric layer 13. The upper dielectric layer 13 may protect the sustain electrode pairs. The passivation layer 14 protects the upper dielectric layer 13 from sputtering of the charged particles and enhances the discharge of secondary electrons.

The address electrodes 22 are formed and intersects the scan electrode 11 and the sustain electrodes 12. A lower dielectric layer 24 and the barrier ribs 21 are formed on the lower substrate 20 on which the address electrodes 22 are formed. A phosphor layer 23 is formed on the lower dielectric layer 24 and the barrier ribs 21.

The phosphor layer 23 is excited by UV rays that are generated upon a gas discharge. As a result, the phosphor layer 23 generates one of R, G, and B rays. A discharge space is provided between the upper and lower substrates 10 and 20 and the barrier ribs 21. A mixture of inert gases, e.g., a mixture of helium (He) and xenon (Xe), a mixture of neon (Ne) and Xe, or a mixture of He, Ne, and Xe is injected into the discharge space.

The barrier ribs 21 include vertical barrier ribs 21*a* which are formed in parallel with the address electrodes 22 and horizontal barrier ribs 21*b* which intersect the address electrodes 22. The barrier ribs 21 define a plurality of discharge cells and prevent ultraviolet (UV) rays and visible rays generated in one discharge cell due to a gas discharge from penetrating other discharge cells.

In this embodiment, red (R), green (G), and blue (B) discharge cells are arranged in a straight line. However, the present invention is not restricted to this. For example, R, G, and B discharge cells may be arranged as a triangle or a delta. Alternatively, R, G, and B discharge cells may be arranged as a polygon such as a rectangle, a pentagon, or a hexagon.

The PDP illustrated in FIG. 1 has a differential barrier structure in which the height of the vertical barrier ribs 21*a* is different from the height of the horizontal barrier ribs 21*b*. More specifically, the height of the horizontal barrier ribs 21*b* is lower than the height of the vertical barrier ribs 21*a*. Thus, according to the embodiment of FIG. 1, it is possible to improve the luminance and brightness of a PDP and effectively exhaust air during the manufacture of a PDP.

The height of the horizontal barrier ribs 21*b* may be 5-32 μm lower than the height of the vertical barrier ribs 21*a*. In this case, a phosphor material, if any, stuck onto a barrier rib can be easily removed and can be prevented from reducing the luminance and brightness of a PDP. In order to facilitate the exhaustion of air, the difference between the height of the vertical barrier ribs 21*a* and the height of the horizontal barrier ribs 21*b* must be 5 μm or more. In order to prevent a reduction in the luminance of a PDP, the difference between the height of the vertical barrier ribs 21*a* and the height of the horizontal barrier ribs 21*b* must be less than 32 μm.

Figure 9:
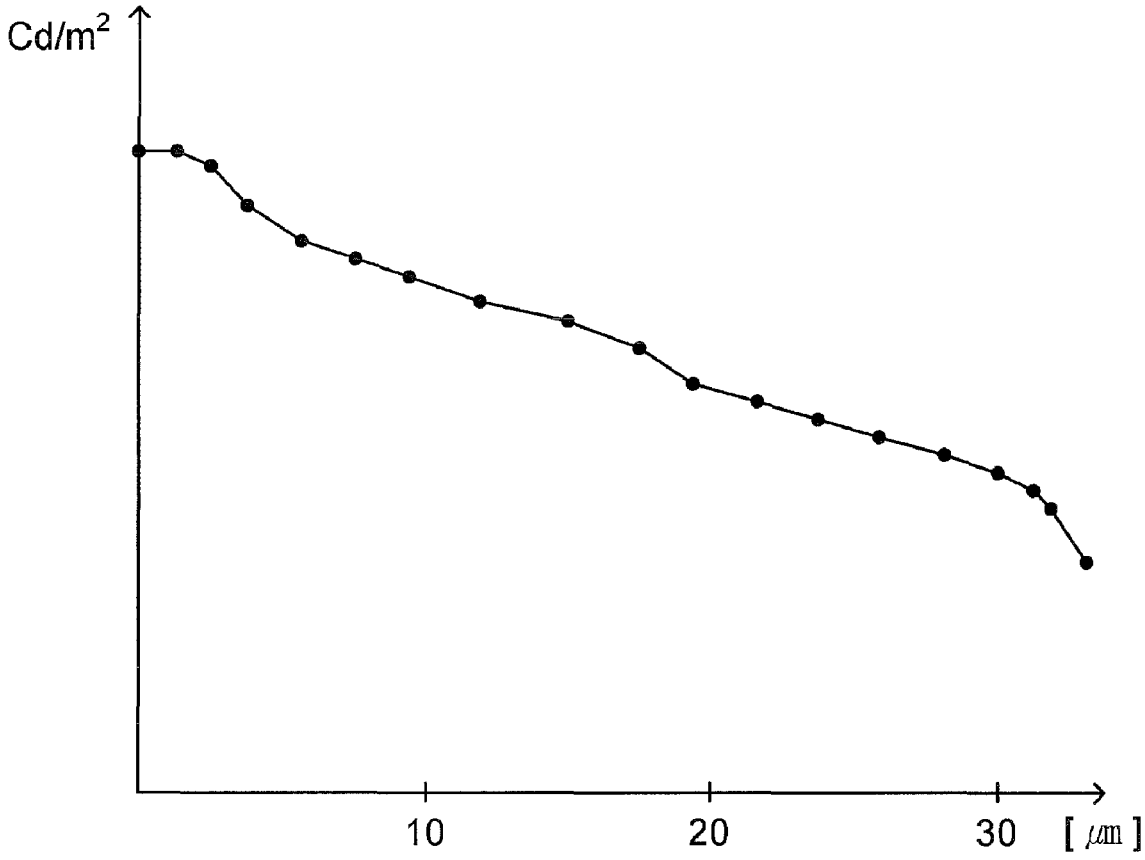
FIG. 9 illustrates a graph of the relationship between luminance and the height of horizontal barrier ribs and the height of vertical barrier ribs.
Figure 10:
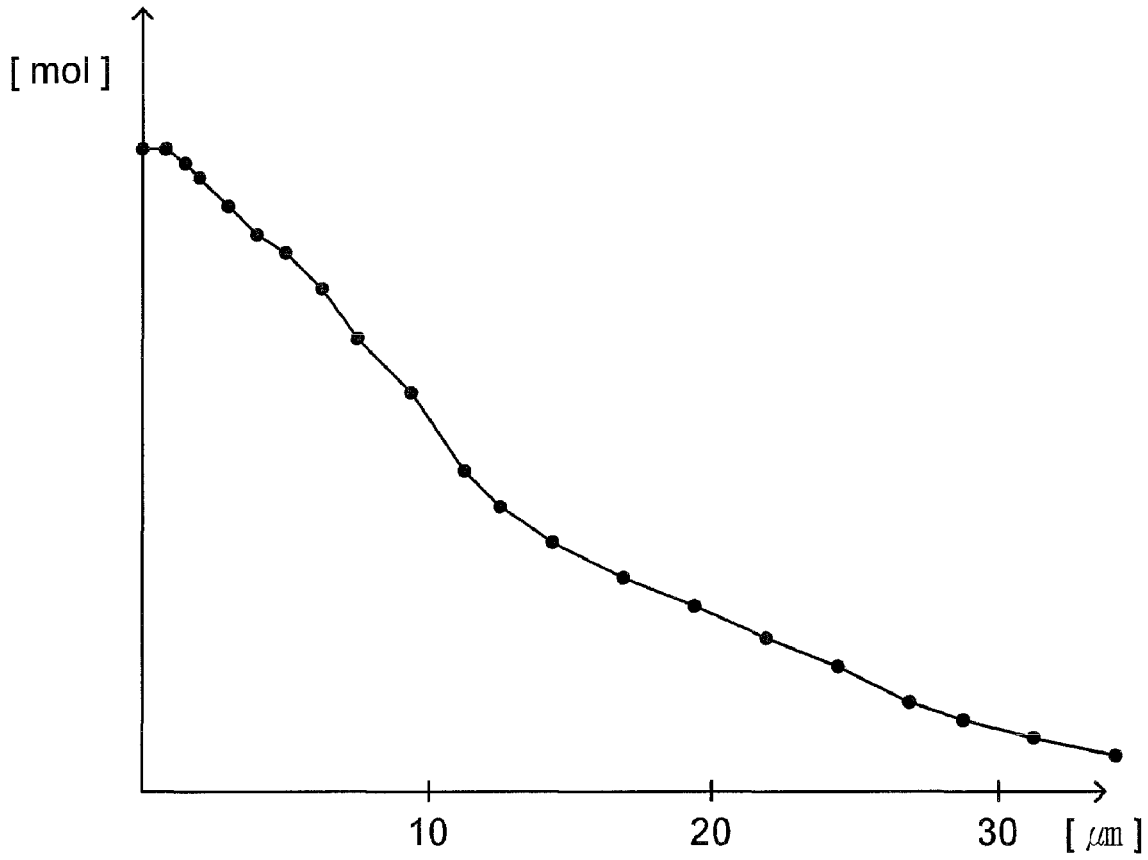
FIG. 10 illustrates a graph of the relationship between gas pollution and the difference between the height of horizontal barrier ribs and the height of vertical barrier ribs.

FIG. 9 illustrates a graph of the relationship between luminance and the height of the horizontal barrier ribs 21*b* and the height of vertical barrier ribs 21*a*, and FIG. 10 illustrates a graph of the relationship between gas pollution and the difference between the height of the horizontal barrier ribs 21*b* and the height of vertical barrier ribs 21*a*.

Referring to FIG. 9, a vertical axis represents luminance, and a horizontal axis represents the difference between the height of the horizontal barrier ribs 21*b* and the height of the vertical barrier ribs 21*a*. As the difference between the height of the horizontal barrier ribs 21*b* and the height of the vertical barrier ribs 21*a* increases within the range of 5-32 μm, luminance linearly decreases. However, once the difference between the height of the horizontal barrier ribs 21*b* and the height of the vertical barrier ribs 21*a* exceeds about 32 μm, luminance drastically decreases for the following reasons: the lower the height of the horizontal barrier ribs 21*b*, the smaller the surface area of discharge cells; the smaller the surface area of discharge cells, the smaller the surface area of phosphor layers; and a reduction in the surface area of phosphor layers may result in a reduction in the luminance of a PDP.

The greater the difference between the height of the horizontal barrier ribs 21*b* and the height of vertical barrier ribs 21*a*, the easier it becomes to exhaust air. Referring to FIG. 10, a vertical axis represents the remaining amount of oxygen and nitrogen, which is an indicator of the degree of gas pollution, and a horizontal axis represents the difference between the height of the horizontal barrier ribs 21*b* and the height of vertical barrier ribs 21*a*. Once the difference between the height of the horizontal barrier ribs 21*b* and the height of vertical barrier ribs 21*a* exceeds about 5 μm, the remaining amount of oxygen and nitrogen considerably decreases. Referring to FIGS. 9 and 10, the difference between the height of the horizontal barrier ribs 21*b* and the height of vertical barrier ribs 21*a* may be determined to be within the range of 5-32 μm, thereby maintaining appropriate luminance and facilitating the exhaustion of air.

Referring to FIG. 1, a plurality of auxiliary electrodes 30 are formed in parallel with the sustain electrode pairs and overlap the horizontal barrier ribs 21*b*. The auxiliary electrodes 30 include a conductive material and are formed as bars. The thickness of the auxiliary electrodes 30 may be substantially the same as the thickness of the sustain electrode pairs, thereby facilitating the manufacture of PDPs and increasing the yield of PDPs.

Figure 11:
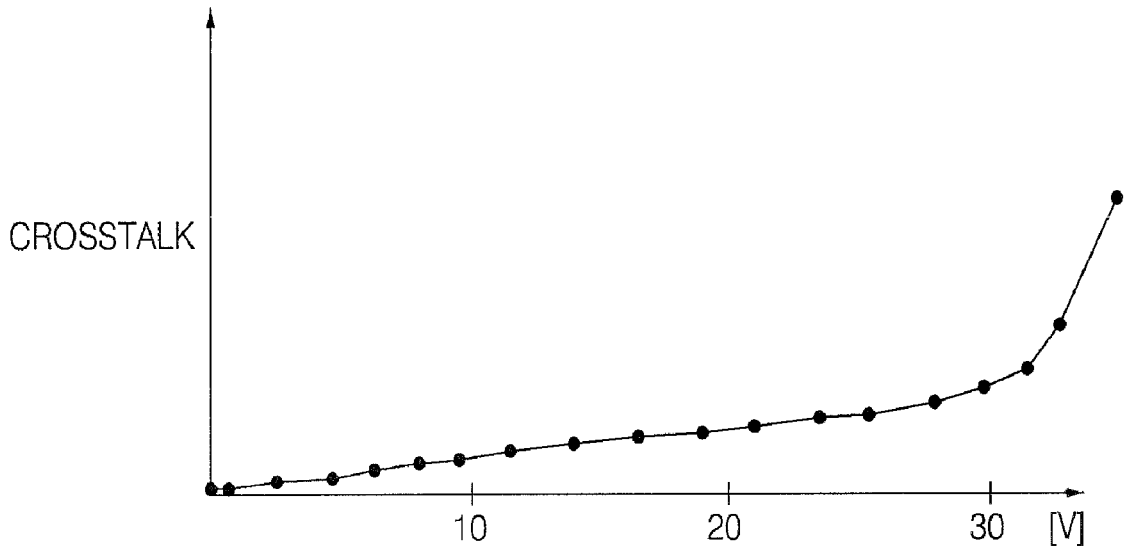
FIG. 11 illustrates a graph of the relationship between a voltage applied to auxiliary electrodes and crosstalk.

The auxiliary electrodes 30 may be floating electrodes which are disconnected from a power source. Floating electrodes block an electric field and can thus prevent crosstalk. In other words, floating electrodes can prevent the occurrence of unnecessary misdischarge by preventing the electric potentials of a scan electrode and a sustain electrode between a pair of adjacent discharge cells from being significantly discrepant from each other. The auxiliary electrodes 30 may be disconnected from a power source and connected to a ground. In this case, the auxiliary electrodes 30 may maintain a ground voltage and may thus be less affected by a voltage applied to a scan electrode and a sustain electrode belonging to different discharge cells. This effect can also be obtained by applying a predetermined voltage to the auxiliary electrodes 30. FIG. 11 illustrates a graph of the relationship between a voltage applied to the auxiliary electrodes 30 and crosstalk. Referring to FIG. 11, a horizontal axis represents a voltage applied to the auxiliary electrodes 30, and a vertical axis represents crosstalk. Only a small amount of crosstalk is generated until the electric potential of the auxiliary electrodes 30 exceeds 30 V. However, once the electric potential of the auxiliary electrodes 30 exceeds 30 V, the amount of crosstalk considerably increases, partly because the electric potential of the auxiliary electrodes 30 becomes too much discrepant from the electric potential of the scan electrodes 11 or the electric potential of the sustain electrodes 12. Therefore, a voltage of −30 V-30 V may be applied to the auxiliary electrodes 30.

In this embodiment, the auxiliary electrodes 30 are spaced apart from the respective sustain electrode pairs. If the auxiliary electrodes 30 are not spaced apart from the respective sustain electrode pairs, the resistance between the scan electrodes 11 and the respective sustain electrodes 12 may become zero. Thus, a short circuit may occur, and a driving circuit may not operate at all. The width of the auxiliary electrodes 30 may be greater than the width of the scan electrodes 11 or the sustain electrodes 12. In this case, it is possible to reduce the probability of the occurrence of crosstalk.

Figure 2:
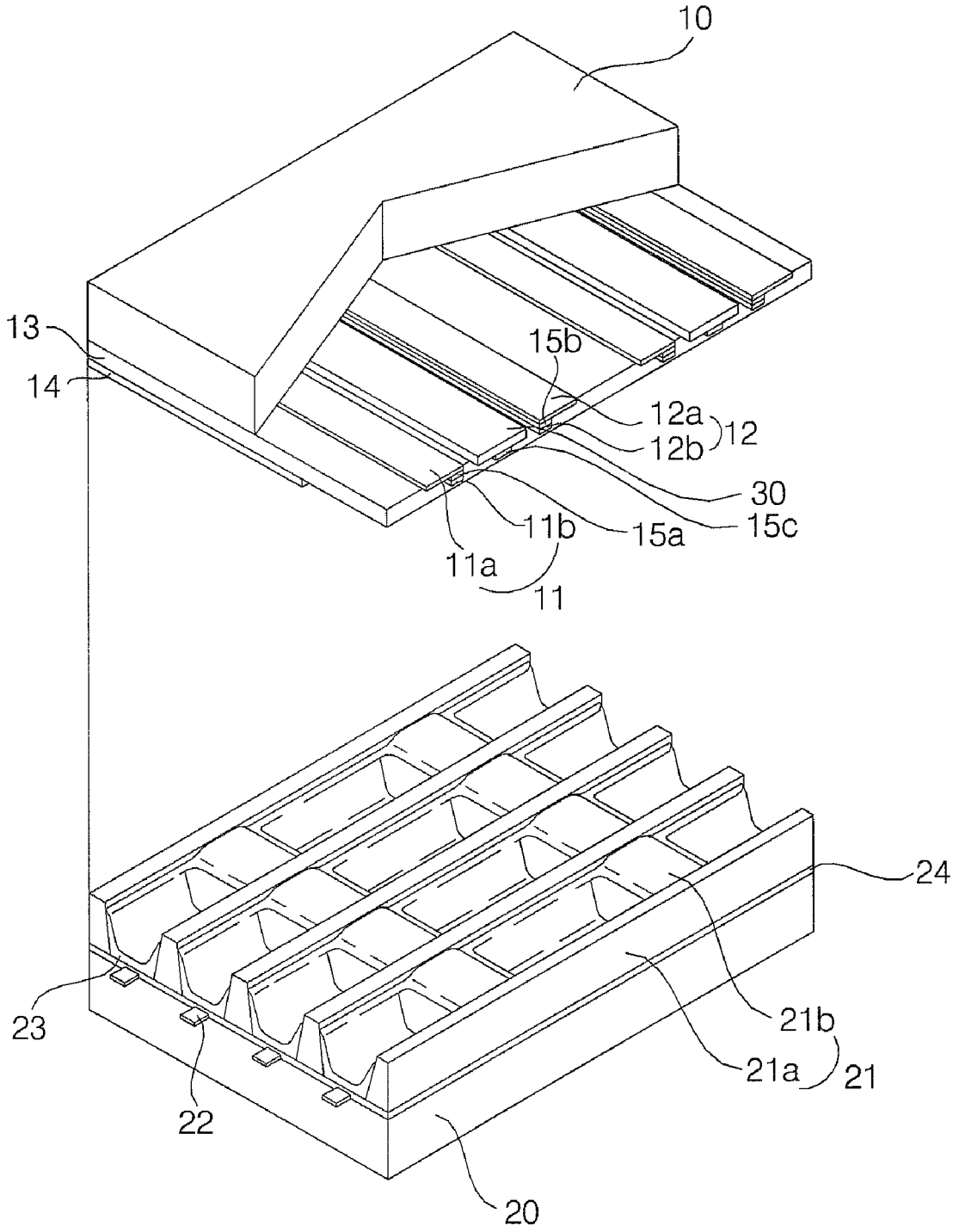
FIG. 2 illustrates a perspective view of a PDP according to another embodiment of the present invention.

FIG. 2 illustrates a perspective view of a PDP according to another embodiment of the present invention. Referring to FIG. 2, the PDP may include black matrices 15. The black matrices 15 perform a light shield function by absorbing external light and reducing the amount of light reflected from an upper substrate 10. The black matrices 15 improve the contrast of the PDP.

The black matrices 15 include first black matrices 15*a* which are disposed between the transparent electrodes 11*a* and the respective bus electrodes 11*b*, first black matrices 15*b* which are disposed between the transparent electrodes 12*a* and the respective bus electrodes 12*b*, and second black matrices 15*c* which are disposed on the first black matrices 15*a* and 15*b* and on the auxiliary electrodes 30.

The second black matrices 15*c* may be referred to as black layers or black electrode layers. The first black matrices 15*a* and 15*b* and the second black matrices 15*c* may be formed at the same time and may thus be physically connected to one another. Alternatively, the first black matrices 15*a* and 15*b* and the second black matrices 15*c* may not be formed at the same time and thus may not be physically connected to one another.

If the first black matrices 15*a* and 15*b* and the second black matrices 15*c* are physically connected to one another, the first black matrices 15*a* and 15*b* and the second black matrices 15*c* may be formed of the same material. However, if the first black matrices 15*a* and 15*b* and the second black matrices 15 are physically separated from one another, the first black matrices 15*a* and 15*b* and the second black matrices 15*c* may be formed of different materials. The second black matrices 15*c* may be optional.

The auxiliary electrodes 30 may be formed of the same material as the transparent electrodes 11*a* and 12*a*, i.e., may be formed of ITO. Alternatively, the auxiliary electrodes 30 may be formed of the same material as the bus electrodes 11*b* and 12*b*, i.e., may be formed of a metal. In this manner, it is possible to facilitate the fabrication of the auxiliary electrodes 30 without a requirement of additional materials or processes.

If the auxiliary electrodes 30 are formed of a dark metal, the contrast of the PDP may be improved. In this case, the first black matrices 15*a* and 15*b* and the second black matrices 15*c* may be replaced with the auxiliary electrodes 30. That is, the auxiliary electrodes 30 may be darker than phosphors and may thus be able to absorb external light and reduce glare. If the first black matrices 15*a* and 15*b* and the second black matrices 15*c* are replaced with the auxiliary electrodes 30 and the auxiliary electrodes 30 are darker than phosphor layer 23, only the first black matrices 15*a* and 15*b* may be formed without forming the second black matrices 15*c*.

The auxiliary electrodes 30 may be formed together with the sustain electrode pairs, thereby facilitating the fabrication of PDPs and increasing the yield of PDPs.

Figure 3A:
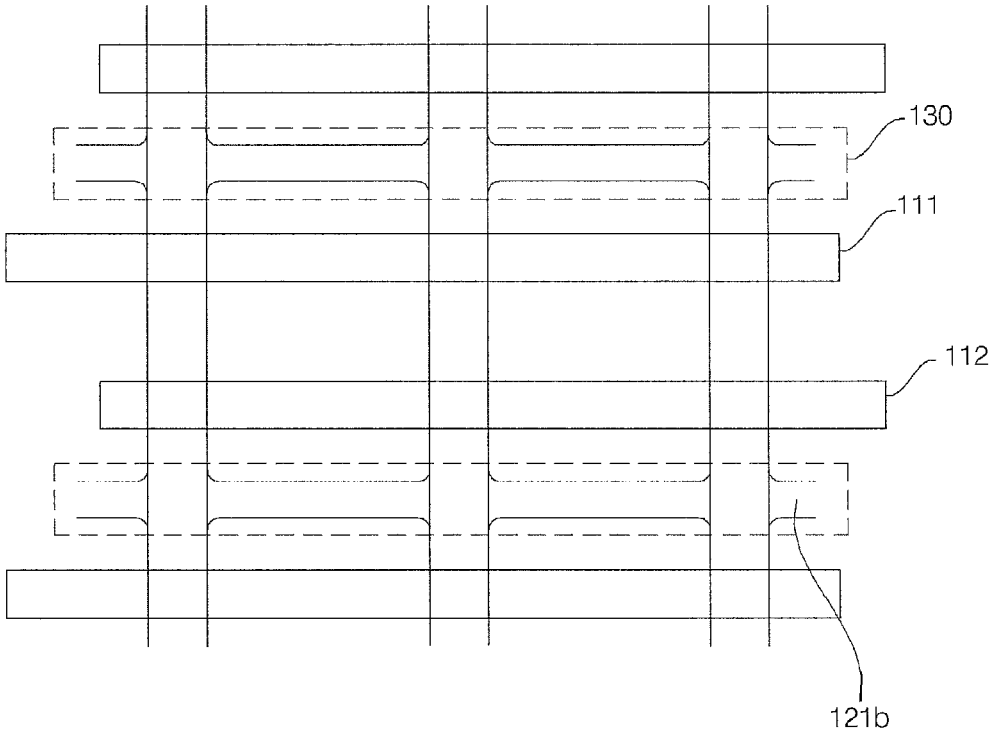
FIGS. 3A and 3B illustrate plan views of the patterns of the arrangement of barrier ribs and sustain electrode pairs of a PDP, according to embodiments of the present invention.
Figure 3B:
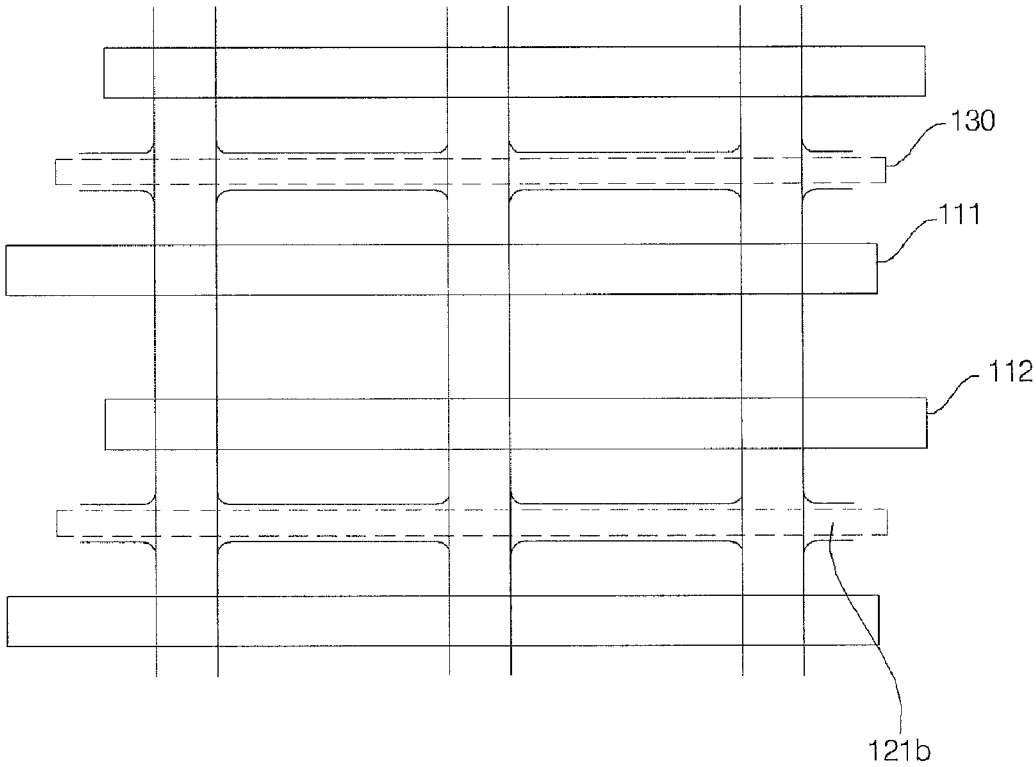

FIGS. 3A and 3B illustrate plan views of the patterns of the arrangement of barrier ribs 121*b* and sustain electrode pairs (111 and 112) of a PDP, according to embodiments of the present invention. Referring to FIGS. 3A and 3B, the width of auxiliary electrodes 130 may be slightly greater than or slightly less than the upper width of horizontal barrier ribs 121*b*. FIG. 3A illustrates the situation when the width of the auxiliary electrodes 130 is slightly greater than the upper width of the horizontal barrier ribs 121*b*, and FIG. 3B illustrates the situation when the width of the auxiliary electrodes 130 is slightly less than the upper width of the horizontal barrier ribs 121*b*.

Figure 3C:
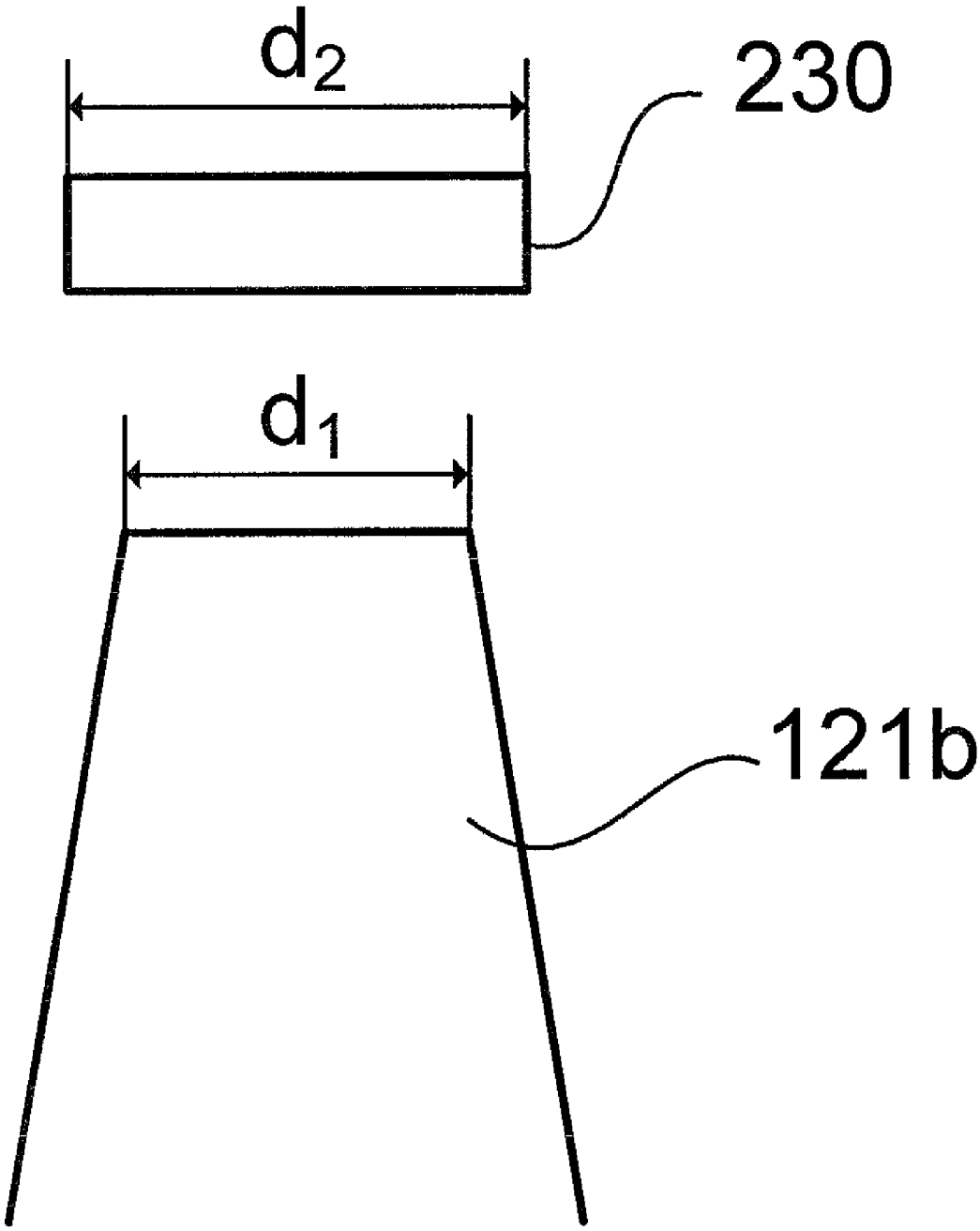
FIG. 3C illustrates cross-sectional views of a horizontal barrier rib and an auxiliary electrode, according to an embodiment of the present invention.
Figure 3D:
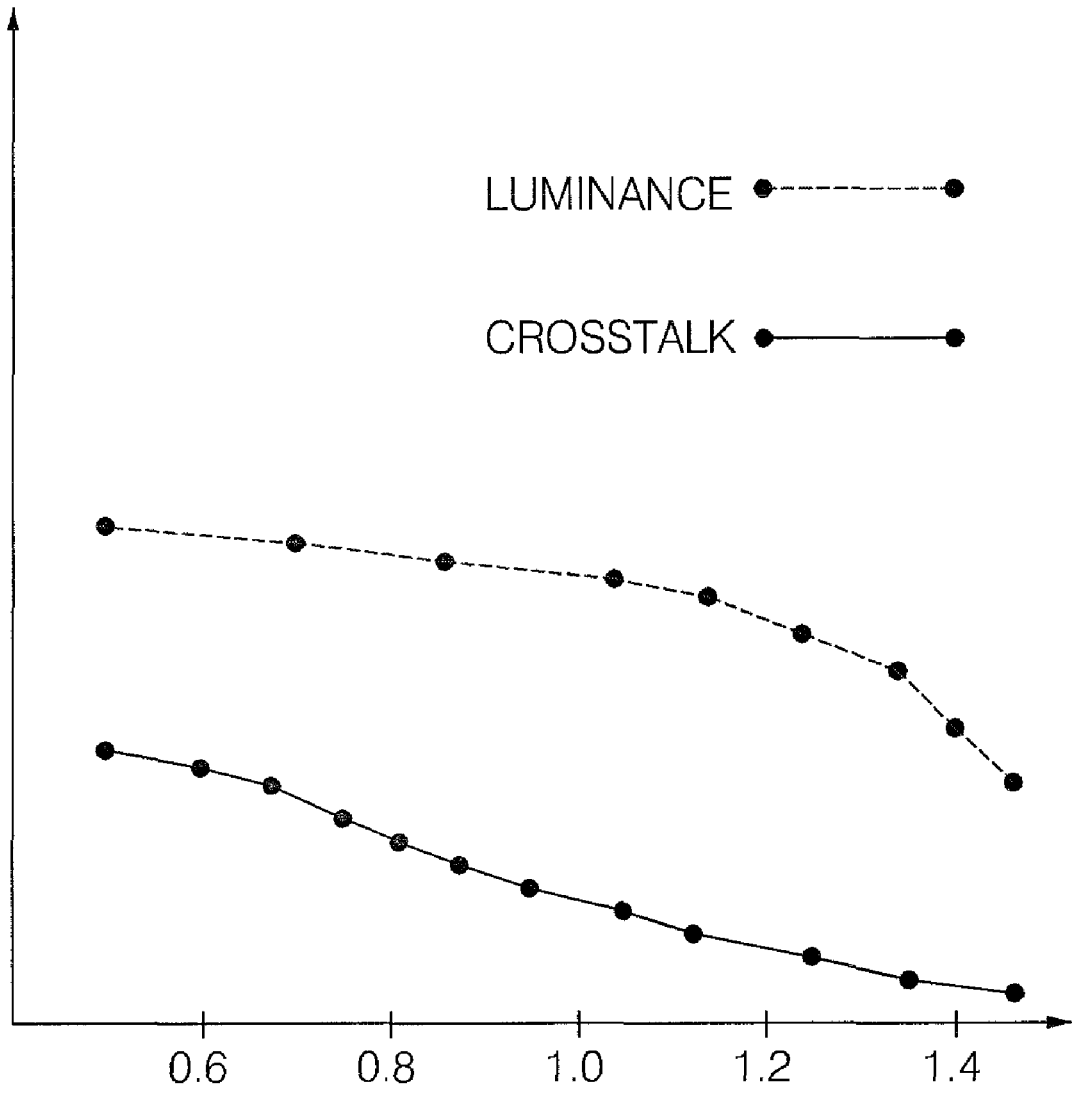
FIG. 3D illustrates graphs of the relationships between luminance and the ratio of the upper width of horizontal barrier ribs and the width of auxiliary electrodes and between crosstalk and the ratio of the upper width of horizontal barrier ribs and the width of auxiliary electrodes.

FIG. 3C illustrates cross-sectional views of a horizontal barrier rib 121*b* and an auxiliary electrode 130, according to an embodiment of the present invention, and FIG. 3D illustrates graphs of the relationships between luminance and the ratio of an upper width d1 of horizontal barrier ribs 130 and a width d2 of auxiliary electrodes 130 and between crosstalk and the ratio of the upper width of horizontal barrier ribs and the width of auxiliary electrodes. Referring to FIG. 3D, once the ratio of the upper width d1 and the width d2 exceeds about 0.7, the amount of crosstalk considerably decreases. When the ratio of the upper width d1 and the width d2 exceeds about 1.3, the level of luminance considerably decreases. Therefore, the ratio of the upper width d1 and the width d2 may be 0.7-1.3. More specifically, the ratio of the upper width d1 and the width d2 may be determined to be 0.9-1.1 given that the level of luminance does not much decrease unless the ratio of the upper width d1 and the width d2 exceeds 1.1, and that the probability of the occurrence of crosstalk is maintained to be very low as long as the ratio of the upper width d1 and the width d2 is 0.9 or greater.

Figure 4A:
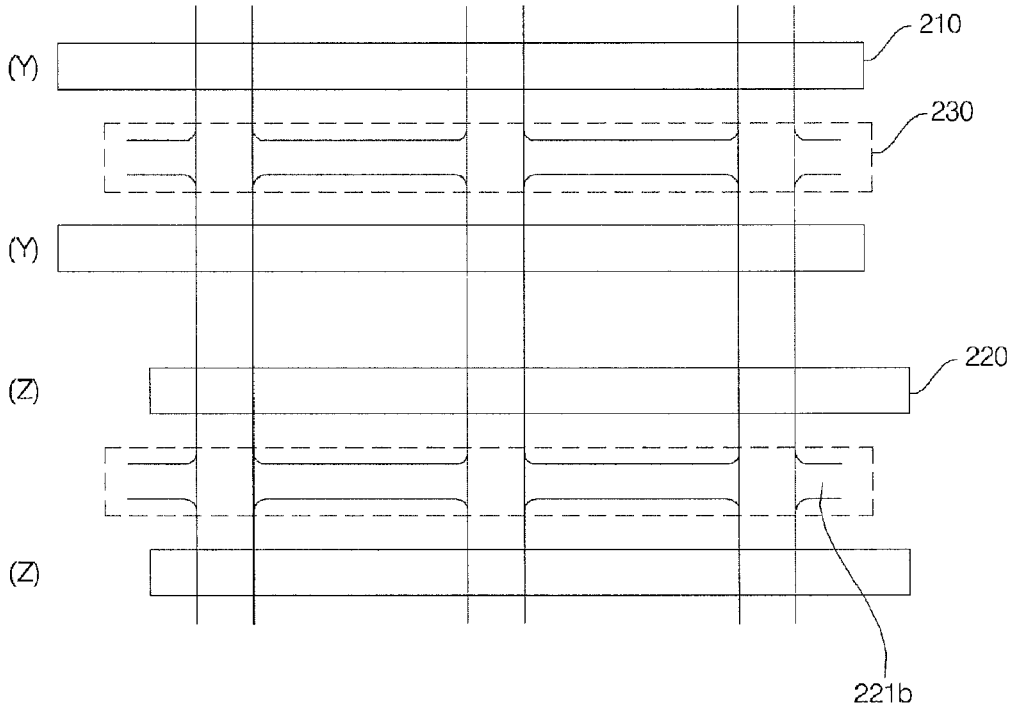
FIGS. 4A and 4B illustrate plan views of the patterns of the arrangement of electrodes of a PDP, according to embodiments of the present invention.
Figure 4B:
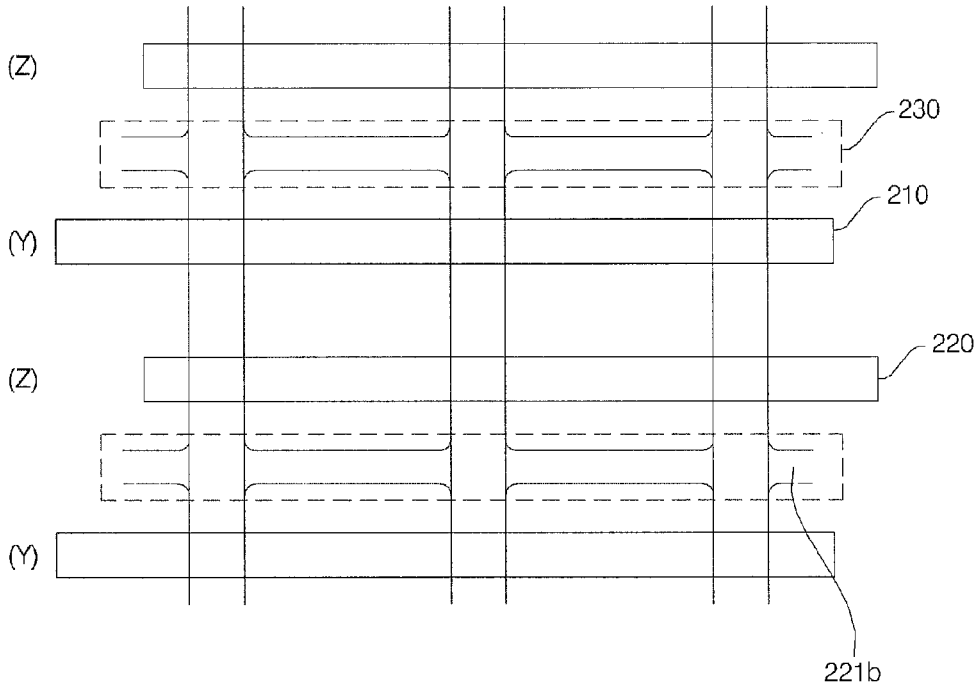

FIGS. 4A and 4B illustrate plan views of the patterns of the arrangement of electrodes of a PDP, according to embodiments of the present invention. Referring to FIGS. 4A and 4B, a plurality of auxiliary electrodes 230 may be interposed between respective corresponding sustain electrode pairs, each comprising a scan electrode 210 and a sustain electrode 220. Thus, the auxiliary electrodes 230 are adjacent not only to the respective scan electrodes 210 but also to the respective sustain electrodes 220. In this case, it is possible to stabilize a sustain discharge and reduce the power consumption of a PDP compared to the situation when the auxiliary electrodes 230 are adjacent only to the respective scan electrodes 210 or to the respective sustain electrodes 220. However, since a voltage is alternately applied to the scan electrodes 210 and the sustain electrodes 220, the difference between the electric potential of the scan electrodes 210 and the electric potential of the respective sustain electrodes 220 increases, and thus, the probability of the occurrence of crosstalk increases.

According to the embodiment of FIGS. 4A and 4B, the auxiliary electrodes 230 may overlap respective corresponding horizontal barrier ribs 221*b*, thereby preventing the occurrence of crosstalk.

Figure 5:
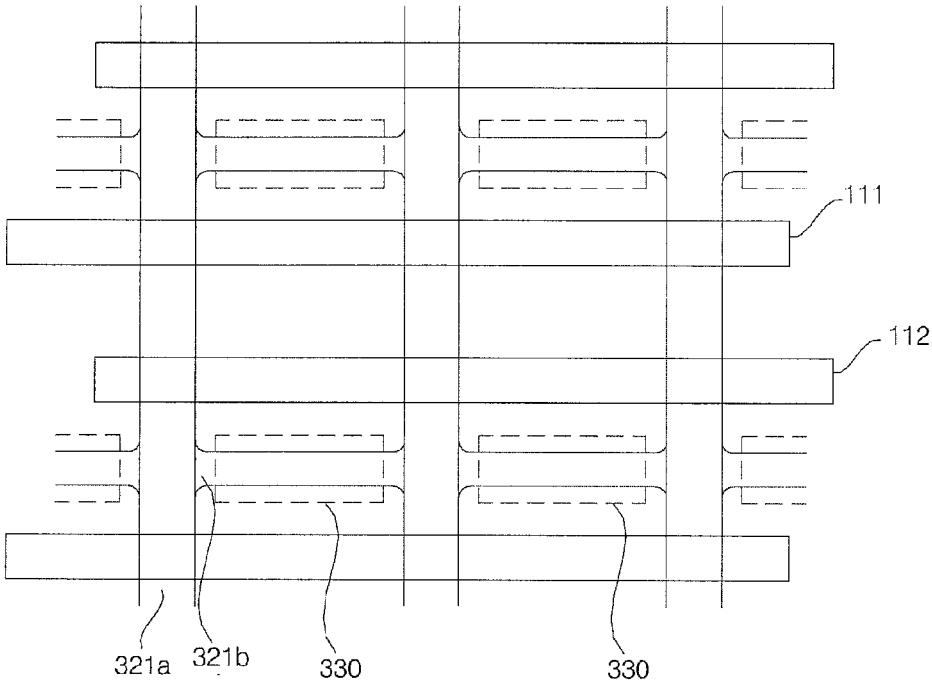
FIG. 5 illustrates a plan view of the pattern of the arrangement of electrodes of a PDP, according to another embodiment of the present invention.

FIG. 5 illustrates a plan view of the pattern of the arrangement of auxiliary electrodes 330 of a PDP according to an embodiment of the present invention. Referring to FIG. 5, the auxiliary electrodes 330 may be discontinuous at the intersections between the horizontal barrier ribs 321*b* are a plurality of vertical barrier ribs 321*a*. In this case, it is possible to reduce the manufacturing cost of a PDP.

Figure 6:
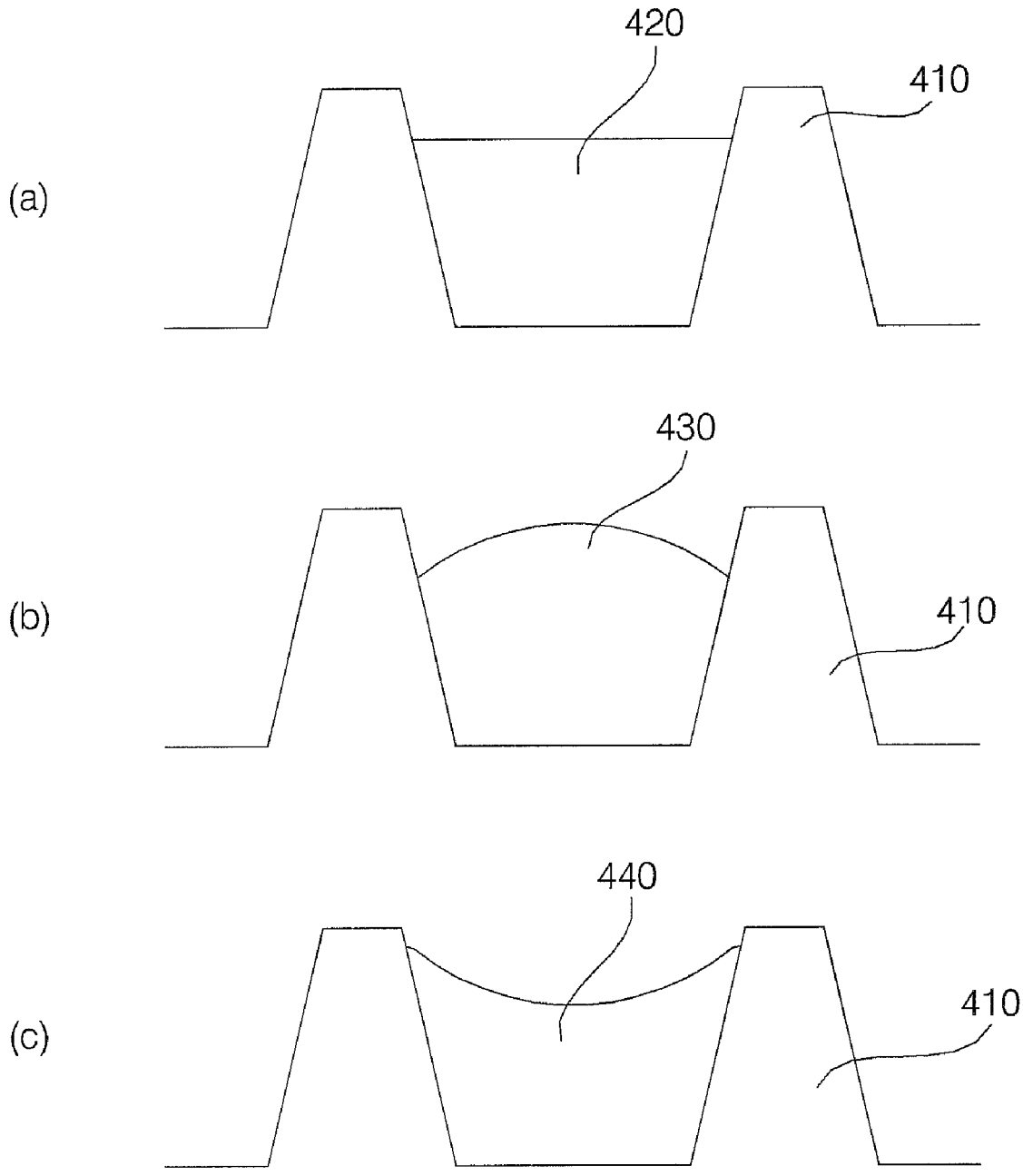
FIGS. 6(*a*) through 6(*c*) illustrate cross-sectional views of barrier rib structures according to embodiments of the present invention.

FIGS. 6(*a*) through 6(*c*) illustrate cross-sectional views of barrier rib structures according to embodiments of the present invention. Referring to FIGS. 6(*a*) through 6(*c*), the height of horizontal barrier ribs 420, 430 and 440 is lower than the height of a vertical barrier rib 410, and thus, the horizontal barrier ribs 420, 430 and 440 may serve as a passage of ventilation. Referring to FIG. 6(*a*), the horizontal barrier rib 420 has a flat top surface. Referring to FIG. 6(*b*), the horizontal barrier rib 430 has a concave top surface. The referring to FIG. 6(*c*), the horizontal barrier rib 440 has a convex top surface. The amount of crosstalk can be reduced further when horizontal barrier ribs have concave top surfaces than when horizontal barrier ribs have convex top surfaces.

Figure 7:
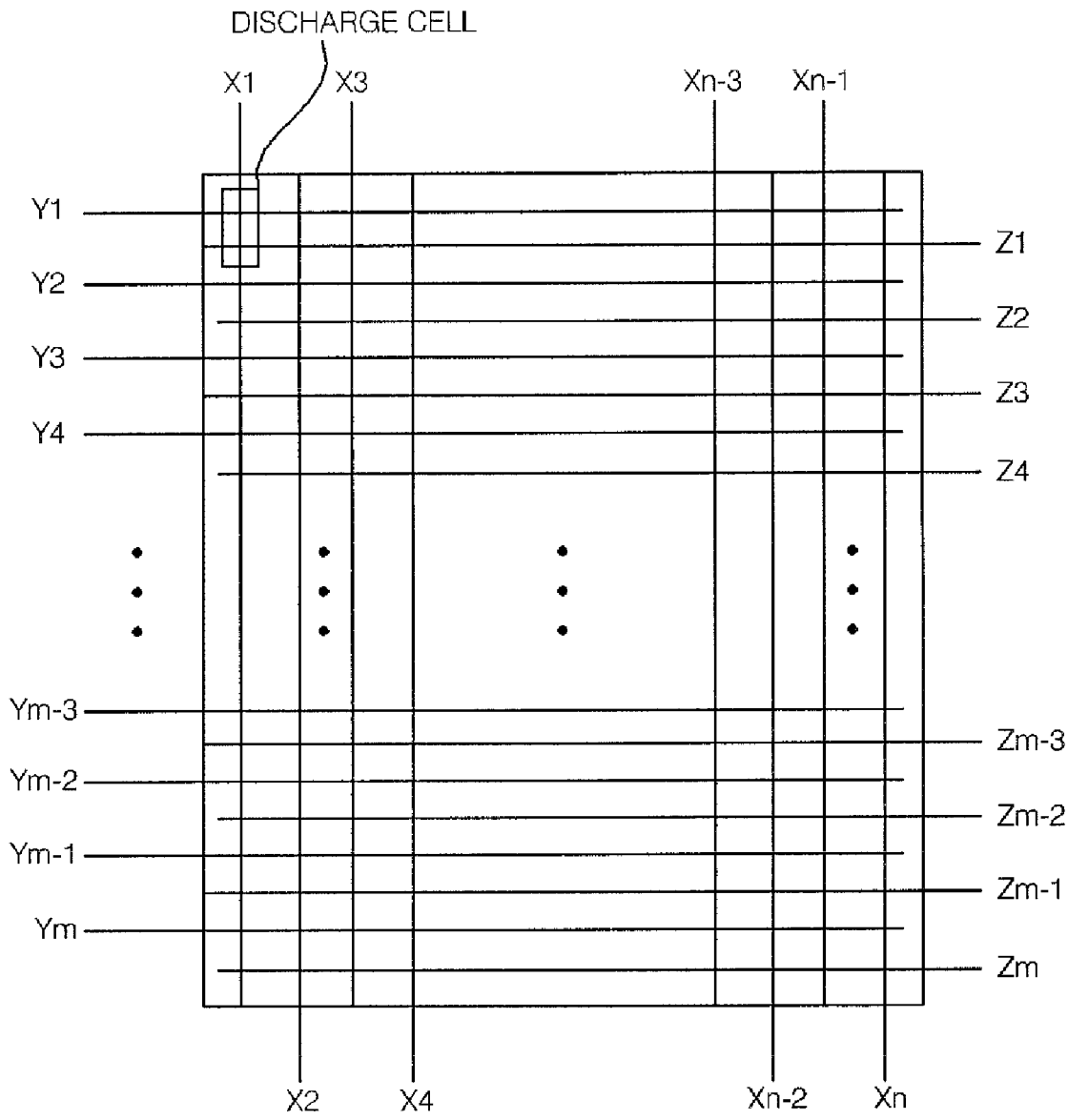
FIG. 7 illustrates a plan view of the pattern of the arrangement of electrodes of a PDP, according to another embodiment of the present invention.

FIG. 7 illustrates a plan view of the pattern of the arrangement of electrodes of a PDP, according to another embodiment of the present invention. Referring to FIG. 7, a plurality of discharge cells may be arranged in a matrix. The discharge cells are respectively disposed at the intersections between a plurality of address electrodes X1 through Xn and a plurality of scan electrode lines Y1 through Ym or a plurality of sustain electrode lines Z1 through Xm. The scan electrode lines Y1 through Ym may be driven sequentially or simultaneously. The address electrode lines X1 through Xn may be divided into two groups, i.e., one group including odd-numbered address electrode lines and the other group including even-numbered address electrode lines, and may be driven in units of the groups.

The electrode arrangement pattern illustrated in FIG. 7 is exemplary. Thus, the present invention is not restricted to the pattern of the arrangement of electrode lines and the method of driving electrode lines set forth herein. For example, the present invention may be applied to a dual scan method by which two of the scan electrode lines Y1 through Ym may be scanned at a time. Also, the address electrode lines X1 through Xn may be divided into two groups, i.e., one group including one half of the address electrode lines X1 through Xn and the other group including the other half of the address electrode lines X1 through Xn, and may be drive in units of the groups.

Figure 8:
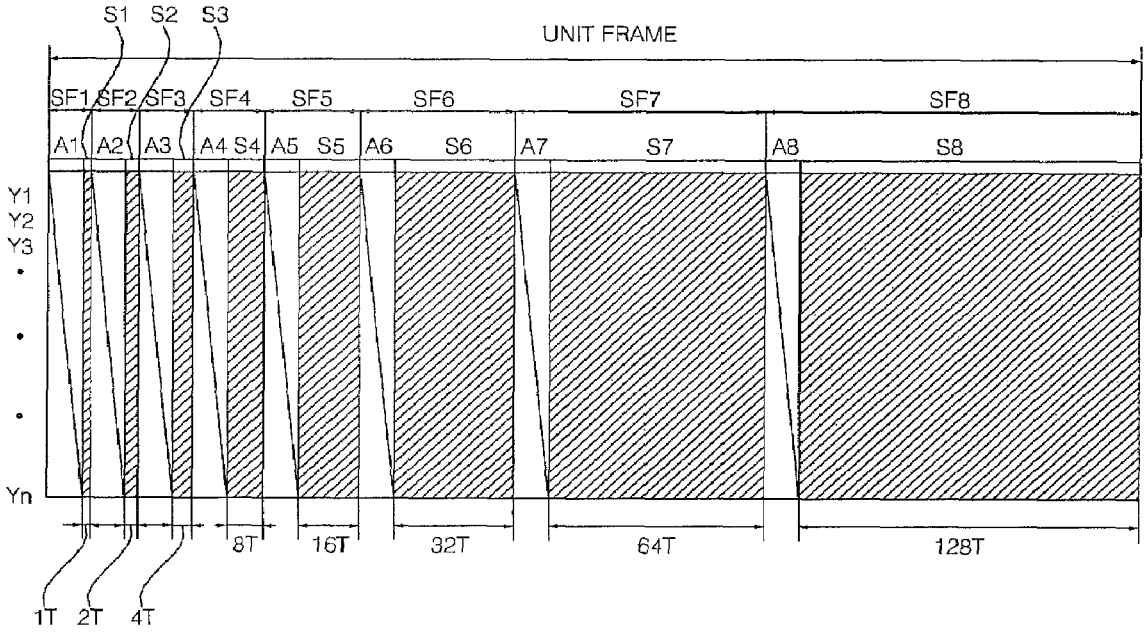
FIG. 8 illustrates a timing diagram of a time-division method of driving a PDP according to an embodiment of the present invention, in which a frame is divided into a plurality of sub-fields.

FIG. 8 illustrates a timing diagram of a time-division method of driving a PDP according to an embodiment of the present invention, in which a frame is divided into a plurality of sub-fields. Referring to FIG. 8, a unit frame may be divided into a predefined number of sub-fields, e.g., eight sub-fields SF1 through SF8, in order to represent grayscale values in a time-division manner. Each of the sub-fields SF1 through SF8 includes a reset period (not shown), an address period (A1, A2, A3, A4, A5, A6, A7 or A8), and a sustain period (S1, S2, S3, S4, S5, S6, S7, or S8).

At least one of the sub-fields SF1 through SF8 may not include a reset period. For example, only the first sub-field SF1 or a sub-field in the middle of a unit frame may include a reset period.

During the address period A1, A2, A3, A4, A5, A6, A7 or A8, an address signal is applied to an address electrode, and a plurality of scan signals respectively corresponding to a plurality of scan electrodes are sequentially applied. During the sustain period S1, S2, S3, S4, S5, S6, S7, or S8, a sustain signal is alternately applied to a scan electrode and a sustain electrode so that a plurality of discharge cells including wall charges generated during the address period A1, A2, A3, A4, A5, A6, A7 or A8 can cause a sustain discharge.

The luminance of a PDP is proportional to the number of sustain discharge pulses generated during the sustain period S1, S2, S3, S4, S5, S6, S7, or S8. If a frame for forming an image is represented by eight sub-fields and 256 grayscale values, 1 sustain signal, 2 sustain signals, 4 sustain signals, 8 sustain signals, 16 sustain signals, 32 sustain signals, 64 sustain signals and 128 sustain signals may be applied to first, second, third, fourth, fifth, sixth, seventh and eighth sub-fields, respectively, of a frame. In order to obtain a grayscale value of 133, discharge cells may be addressed during first, third sub-field, and eighth sub-fields of a frame so that the discharge cells can cause a sustain discharge.

The number of sustain discharges allocated to each of a plurality of sub-fields of a frame may vary according to the weights respectively allocated to the plurality of sub-fields during an automatic power control (APC) operation. That is, a frame is illustrated in FIG. 8 as being divided into eight sub-fields, but the present invention is not restricted to this. The number of sub-frames of a frame may vary according to design specification. For example, a frame may be divided into more than eight sub-frames, e.g., twelve or sixteen sub-fields. Also, the number of sustain discharges allocated to each of a plurality of sub-fields of a frame may vary according to the gamma characteristics and other physical characteristics of a PDP. For example, a gray scale of 6, instead of a grayscale of 8, may be allocated to a fourth sub-field of a frame, and a grayscale value of 34, instead of a grayscale value of 32, may be allocated to a sixth sub-field of a frame.

In the case of driving a PDP in the above-mentioned manner, a number of sustain discharges are required to occur during each of a plurality of a frame in order to continuously display a still image or to display more than one image with the same grayscale. Thus, phosphors may have to be continuously turned on in order to display even the same image or even the same grayscale and may thus deteriorate. Therefore, various problems such as grayscale fluctuations, afterimages, or luminance reductions may arise. In this embodiment, in order to address these problems, an image sticking minimization (ISM) mode in which the number of sustain pulses is reduced for the situations when the same image is displayed over and over may be adopted.

As described above, according to the present invention, it is possible to improve the luminance and brightness of a PDP using horizontal barrier ribs that are lower than vertical barrier ribs. In addition, it is possible to prevent the occurrence of crosstalk and thus to prevent the occurrence of invalid power by forming floating electrodes to overlap respective corresponding horizontal barrier ribs.

Moreover, it is possible to improve the contrast of a PDP by forming floating electrodes of a dark metal. Furthermore, it is possible to facilitate the fabricate of a PDP by forming floating electrodes of a transparent conductive material such as ITO.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display device comprising:

a plasma display panel (PDP);

an upper substrate and a lower substrate that face each other;

a plurality of scan electrodes and a plurality of sustain electrodes that are disposed on the upper substrate;

a plurality of first barrier ribs that are disposed on the lower substrate in parallel with the scan electrodes and the sustain electrodes;

a plurality of second barrier ribs that are disposed on the lower substrate, that intersect the first barrier ribs, and are higher than the first barrier ribs; and a plurality of auxiliary electrodes that are disposed on the upper substrate and overlap the first barrier ribs, wherein the auxiliary electrodes are spaced apart from the respective scan electrodes and from the respective sustain electrodes.

2. The plasma display device of claim 1, wherein a width of the auxiliary electrodes is greater than at least one of a distance between the auxiliary electrodes and the respective scan electrodes and a distance between the auxiliary electrodes and the respective sustain electrodes.

3. The plasma display device of claim 1, wherein the auxiliary electrodes comprise floating electrodes that are disconnected from a power supply.

4. The plasma display device of claim 1, wherein the auxiliary electrodes are connected to a ground.

5. The plasma display device of claim 1, wherein a predetermined voltage is applied to the auxiliary electrodes.

6. The plasma display device of claim 1, wherein the auxiliary electrodes comprise indium tin oxide (ITO).

7. The plasma display device of claim 1, wherein the auxiliary electrodes are darker than phosphors that emit light upon receiving ultraviolet rays generated during a discharge.

8. The plasma display device of claim 1, wherein the auxiliary electrodes comprise black matrices.

9. The plasma display device of claim 1, wherein the auxiliary electrodes are adjacent to the respective scan electrodes and to the respective sustain electrodes.

10. The plasma display device of claim 1, wherein the auxiliary electrodes are discontinuous.

11. The plasma display device of claim 10, wherein the auxiliary electrodes are discontinuous at intersections between the first barrier ribs and the second barrier ribs.

12. The plasma display device of claim 1, wherein a width of the auxiliary electrodes is 0.7-1.3 times greater than an upper width of the first barrier ribs.

13. The plasma display device of claim 1, wherein a width of the auxiliary electrodes is 0.9-1.1 times greater than an upper width of the first barrier ribs.

14. The plasma display device of claim 1, wherein some of the first barrier ribs have concave top surfaces.

15. The plasma display device of claim 1, wherein a height of the first barrier ribs is 5-32 μm less than a height of the second barrier ribs.

16. The plasma display device of claim 1, wherein a thickness of the auxiliary electrodes is substantially the same as at least one of a thickness of the scan electrodes and a thickness of the sustain electrodes.

17. A plasma display device comprising:

a plasma display panel (PDP);

an upper substrate;

a lower substrate;

a plurality of scan electrodes and a plurality of sustain electrodes provided on the upper substrate;

a plurality of first barrier ribs provided on the lower substrate in parallel with the scan electrodes and the sustain electrodes;

a plurality of second barrier ribs on the lower substrate that intersect the first barrier ribs, wherein a height of the plurality of second barrier ribs is greater than a height of the plurality of first barrier ribs; and a plurality of auxiliary electrodes that overlap the first barrier ribs, wherein the auxiliary electrodes are spaced on the upper substrate from the respective scan electrodes and are spaced on the upper substrate from the respective sustain electrodes.

18. The plasma display device of claim 17, wherein a width of the auxiliary electrodes is greater than a distance between the auxiliary electrodes and the respective scan electrodes or a distance between the auxiliary electrodes and the respective sustain electrodes.

19. The plasma display device of claim 17, wherein the auxiliary electrodes comprise floating electrodes that are disconnected from a power supply.

20. The plasma display device of claim 17, wherein the auxiliary electrodes comprise indium tin oxide (ITO).

* * * * *